US006595143B2

(12) United States Patent
London

(10) Patent No.: US 6,595,143 B2
(45) Date of Patent: Jul. 22, 2003

(54) CHILDREN'S ACTIVITY TABLE

(76) Inventor: Jeffrey J. London, 20306 Thunderhead Way, Germantown, MD (US) 20874

( * ) Notice: Subject to any disclaimer, the term of this patent is extended or adjusted under 35 U.S.C. 154(b) by 0 days.

(21) Appl. No.: 09/981,097

(22) Filed: Oct. 18, 2001

(65) Prior Publication Data

US 2002/0048744 A1 Apr. 25, 2002

Related U.S. Application Data

(60) Provisional application No. 60/241,371, filed on Oct. 19, 2000.

(51) Int. Cl.[7] ..... A47B 85/00
(52) U.S. Cl. ..... 108/25
(58) Field of Search ..... 108/25, 26, 157.16, 108/44, 45, 43; 434/432

(56) References Cited

U.S. PATENT DOCUMENTS

| | | | | |
|---|---|---|---|---|
| 1,251,661 | A | * | 1/1918 | Hendershott |
| 1,738,276 | A | | 12/1929 | Barney |
| 1,879,087 | A | * | 9/1932 | Chomik |
| 3,714,908 | A | | 2/1973 | Notko |
| 4,057,244 | A | * | 11/1977 | Gaspar |
| 4,358,958 | A | | 11/1982 | Wehrenberg |
| D295,423 | S | | 4/1988 | Battaglia |
| 4,807,538 | A | * | 2/1989 | Hoffman |
| 5,366,189 | A | | 11/1994 | Thompson |
| 5,435,510 | A | | 7/1995 | Wey |
| 5,527,568 | A | | 6/1996 | Boone et al. |
| D371,806 | S | | 7/1996 | Boone et al. |
| 5,725,380 | A | | 3/1998 | Kennelly |
| 5,878,672 | A | * | 3/1999 | Ostermann et al. |
| 6,205,936 | B1 | * | 3/2001 | Nelson et al. |
| 6,321,662 | B1 | * | 11/2001 | Fraise |
| 6,427,604 | B1 | * | 8/2002 | Chrobak |

FOREIGN PATENT DOCUMENTS

| | | |
|---|---|---|
| GB | 2203034 | 10/1988 |

* cited by examiner

*Primary Examiner*—Jose V. Chen
(74) *Attorney, Agent, or Firm*—Richard C. Litman

(57) ABSTRACT

A children's activity table includes a table top with a dry erasable "whiteboard" surface, for writing, drawing, and marking thereon. The periphery of the table top includes a series of recessed areas, which provide for the removable placement of one or more boards having a series of removable alphanumeric characters thereon. The characters preferably extend slightly past the edges of the boards and periphery of the table top, so young children and toddlers with limited manual dexterity may more easily retrieve the characters. A series of openings are formed in the table top, for removable placement of a corresponding number of storage containers therein for holding erasable markers, cleaning cloths, and the like. A central opening provides storage space for a tissue box or the like, with the tissues serving as erasers for the erasable surface of the table top.

18 Claims, 6 Drawing Sheets

CHILDREN'S ACTIVITY TABLE

CROSS-REFERENCE TO RELATED APPLICATION

This application claims the benefit of U.S. Provisional Patent Application Serial No. 60/241,371, filed Oct. 19, 2000.

BACKGROUND OF THE INVENTION

1. Field of the Invention

The present invention relates generally to various articles of furniture adapted particularly to younger persons, and more specifically to a children's activity table having various educational features thereon. The present table includes a writing or marking surface thereon and disassembles by means of removal of two cruciform leg panels.

2. Description of the Related Art

It has long been recognized that the earlier educational development is begun with young children, the easier and more complete their education is likely to be. Most parents do all within reason to ensure that their children begin the learning process very early in life, at least on an informal basis. Accordingly, innumerable educational toys, games, and equipment have been provided for children in the past. As an example, chalk boards and the like having the alphabet and single digit numbers thereon, have been known for generations.

However, most such educational toys, games, and other devices have been relatively limited in the scope of the learning activities which they provide. The chalk board example noted above only provides an erasable writing surface, with no provision for removable letters and numbers which may be arranged on a surface as desired. Where such letters and numbers are provided (e. g., alphabetic blocks, etc.), no surface is provided to secure them in place as desired. Also, while various educational games and other activities have been developed in the past, they are each relatively narrow in the field or scope of education which they provide. Moreover, such games and the like generally require some form of table or other surface upon which they may be placed for use.

Accordingly, a need will be seen for a children's activity table which provides various educational and entertainment activities for small children. The present table is configured particularly for small children, having a height and size adapted for the relatively small stature of such children. The present table includes an erasable marking surface ("whiteboard") thereon, and provision for holding an assortment of erasable markers and erasing means at various points on the table. Each edge of the table also includes a series of removably attachable alphanumeric characters, which may be arranged as desired by children using the present activity table invention. The present table is easily disassembled for storage by removing a pair of flat leg panels assembled in a cruciform plan for supporting the table for use.

A discussion of the related art of which the present inventor is aware, and its differences and distinctions from the present invention, is provided below.

U.S. Pat. No. 1,738,276 issued on Dec. 3, 1929 to Freeman Barney, titled "Standard," describes a cruciform support having an open area in the upper and lower centers thereof when assembled. The two support panels are identical to one another, with each having an opening to each side thereof with a flange completely surrounding the perimeter. Barney fails to disclose any form of table or other article for placement upon his standard. Moreover, while he discloses that the two panels may be secured to one another by a bolt, he also fails to disclose any means of positively securing a table or any other article to his standard. The present table does not positively secure the two leg panels to one another (other than by their mating slots), but rather bolts the overlying table to the two panels to form a secure assembly.

U.S. Pat. No. 3,714,908 issued on Feb. 6, 1973 to Michael F. Notko, titled "Fiber Board Table," describes a round table having a pair of leg panels forming a cruciform support when assembled. Each leg panel is folded from a sheet of fiberboard, rather than being formed of a single sheet of a more durable material (wood, plastic, etc.) as in the present table. Moreover, the Notko leg assembly requires further reinforcement across its upper center and beneath the table surface in the form of another fiberboard panel, which precludes installation of an opening therein for containing an article, as provided by the present table.

U.S. Pat. No. 4,358,958 issued on Nov. 16, 1982 to Charles C. Wehrenberg, titled "Attachable, Level-Correcting Volumeter And Stand For Round Bottom Flasks," describes a cruciform support formed of two flat panels which secure together by means of mating slots in their bottom centers. The upper portions of the panels are open for receipt of a round bottom flask, and serve to support such a flask in a generally upright position. However, no means of positively securing the panels to an overlying flat surface (table, etc.) is disclosed. In fact, the Wehrenberg disclosure teaches away from the relatively rigid panels of the present table assembly, stating that the two panels are flexible to allow them to deflect for installation about a flask (column 2, lines 34–36).

U.S. Pat. No. 5,366,189 issued on Nov. 22, 1994 to Thomas P. Thompson, titled "Shopper's Caddy," describes a cruciform support formed of two slotted panels which interlock when assembled. The panels each include bag retention means adjacent their outer corners, for holding the handles of one or more conventional grocery bags or the like. Thompson does not provide any means for securing a flat table top to his support, nor does he anticipate such a need, as the embodiment of FIGS. 4*a* and 4*b* of his patent show upwardly extending knobs, which would preclude the resting of a flat surface across the upper edges of the cruciform panels. Moreover, Thompson does not provide any leg clearance or container receptacle openings in the lower or upper portions of his panels, as provided in the present children's activity table.

U.S. Pat. No. 5,435,510 issued on Jul. 25, 1995 to Louis Wey et al., titled "Detachable Table Stand Assembly," describes a table support comprising four separable legs, with each leg comprising a three dimensional frame formed of rods. The legs do not interlock together to form a cruciform structure, but are secured together by a series of clamps. While they may be disassembled from one another, they cannot fold or lie flat, as can the present table top flat support panels. Moreover, Wey et al. do not disclose any means of positively securing a table top to the upper portion of the leg assembly, whereas the present children's activity table includes such positive locking or securing means.

U.S. Pat. No. 5,527,568 issued on Jun. 18, 1996 to Michael K. Boone et al., titled "Combination Bulletin Board An (sic) Dry-Erase Message Board," describes a board having a dry-erase "whiteboard" area with a surrounding cork board area. The only points in common between the Boone et al. board and the present children's activity table, is the use of a dry-erase whiteboard material for the central portion thereof. The present table does not have a penetrable border therearound, as it is not desirable to provide sharp objects for pinning notes or the like to the material of the present table, given its intended use by very small children. Moreover, the Boone et al. board teaches away from the border of the present table due to the raised periphery of the Boone et al. board, which would preclude ease of access of articles resting upon the border area. Most importantly, Boone et al. do not disclose any leg support means for their board.

U.S. Pat. No. 5,725,380 issued on Mar. 10, 1998 to Kim Kennelly, titled "Combination Writing Board And Abacus," describes a device having a folding frame with an abacus extending across the upper portion and a writing board extending from the upper portion, outwardly across the lower portion of the frame. The only point in common with the present invention is the use of a dry erase type material for the writing board. Kennelly does not provide any form of disassembleable cruciform support panels for a raised table surface, as provided by the present invention. Moreover, no border area for the removable placement of alphanumeric characters or other articles thereon, is provided by Kennelly. The writing board surface is unbroken, and cannot provide storage receptacles for articles, which feature is a part of the present invention.

U.S. Pat. No. D-295,423 issued on Apr. 26, 1988 to Joseph R. Battaglia, titled "Erasable Memorandum Board With Advertising Space," illustrates a design having a series of relatively smaller areas generally peripherally disposed about a larger generally central area. No support means, storage receptacles, or lowered peripheral article storage border area is apparent in the Battaglia design, which features are a part of the present invention.

U.S. Pat. No. D-371,806 issued on Jul. 16, 1996 to Michael K. Boone et al., titled "Dry-Erase Board With Paper Pocket," illustrates a design which closely resembles the article of the '568 U.S. Patent to the same inventors, discussed further above. The same points of difference between that article and the present invention, are seen to apply here as well.

Finally, British Patent Publication No. 2,203,034 published on Oct. 12, 1988 to Corrugations Limited, titled "Article Of Furniture," describes a table having a cruciform support structure. The components are formed of relatively thin sheets of paper board or the like, with the two support panels each being folded to have a relatively great thickness for suitable structural strength for the materials used. No upper or lower cutouts for a receptacle or for leg clearance for users is provided, and the table surface merely rests upon the upper edges of the leg panels, rather than being positively attached thereto, as in the present children's activity table invention. The table of the Corrugations Limited '034 British Patent Publication thus more closely resembles the table of the '908 U.S. Patent described further above, than the present table invention.

None of the above inventions and patents, taken either singly or in combination, is seen to describe the instant invention as claimed.

SUMMARY OF THE INVENTION

The present invention comprises a children's activity table providing a writing, marking, gaming, and play surface particularly suited for use by very small children and toddlers. The present table includes a "whiteboard" type dry erasable surface, with a recessed periphery providing for removable placement and storage of a series of alphanumeric characters or other articles thereon, as desired.

The center of the table has an opening therein, for removably holding a tissue container or the like therein for erasing any marks on the table surface as desired. The table is preferably generally square in plan view, with each of the corners having an opening therethrough for removable placement of an article container therein, for holding markers, alphanumeric characters, used erasing tissues, and/or other articles therein as desired.

The table top is supported by a pair of relatively thin, flat, and rigid panels, each of which includes a central slot therein. The two slots complement one another, so the two panels may be assembled together in a cruciform configuration by engaging their mutual slots with one another. The two panels include leg clearance for persons using the table and an upper clearance in registry with the central opening in the table top, for holding a tissue dispenser or other article therein.

The underside of the table top includes a set of battens or cleats, which engage the upper edges of the support panels. Concentric holes in the cleats and the upper edges of the support panels accept bolts therethrough, with the bolts being secured by wing nuts or other hand manipulable fasteners for securing the table top and support panels together as desired. The present children's activity table is thus easily assembled for use and disassembled for storage or transport, by unfastening the fasteners, removing the table top, and separating the two table supports to form a series of three flat and thin panels which require very little room for storage.

Accordingly, it is a principal object of the invention to provide an improved children's activity table having a dry erasable table top surface and at least one recessed peripheral area for removably holding various articles thereon.

It is another object of the invention to provide an improved children's activity table which table top includes one or more openings therein for removable placement of a corresponding number of storage receptacles therein.

It is a further object of the invention to provide an improved children's activity table formed of a thin, flat, rigid table top panel and first and second thin, flat, rigid interlocking leg support panels.

An additional object of the invention is to provide an improved children's activity table which interlocking leg support panels each have a mutually engaging slot for assembling the two panels in a cruciform configuration.

Still another object of the invention is to provide an improved children's activity table including means for positively but removably securing the top to the assembled support panels.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
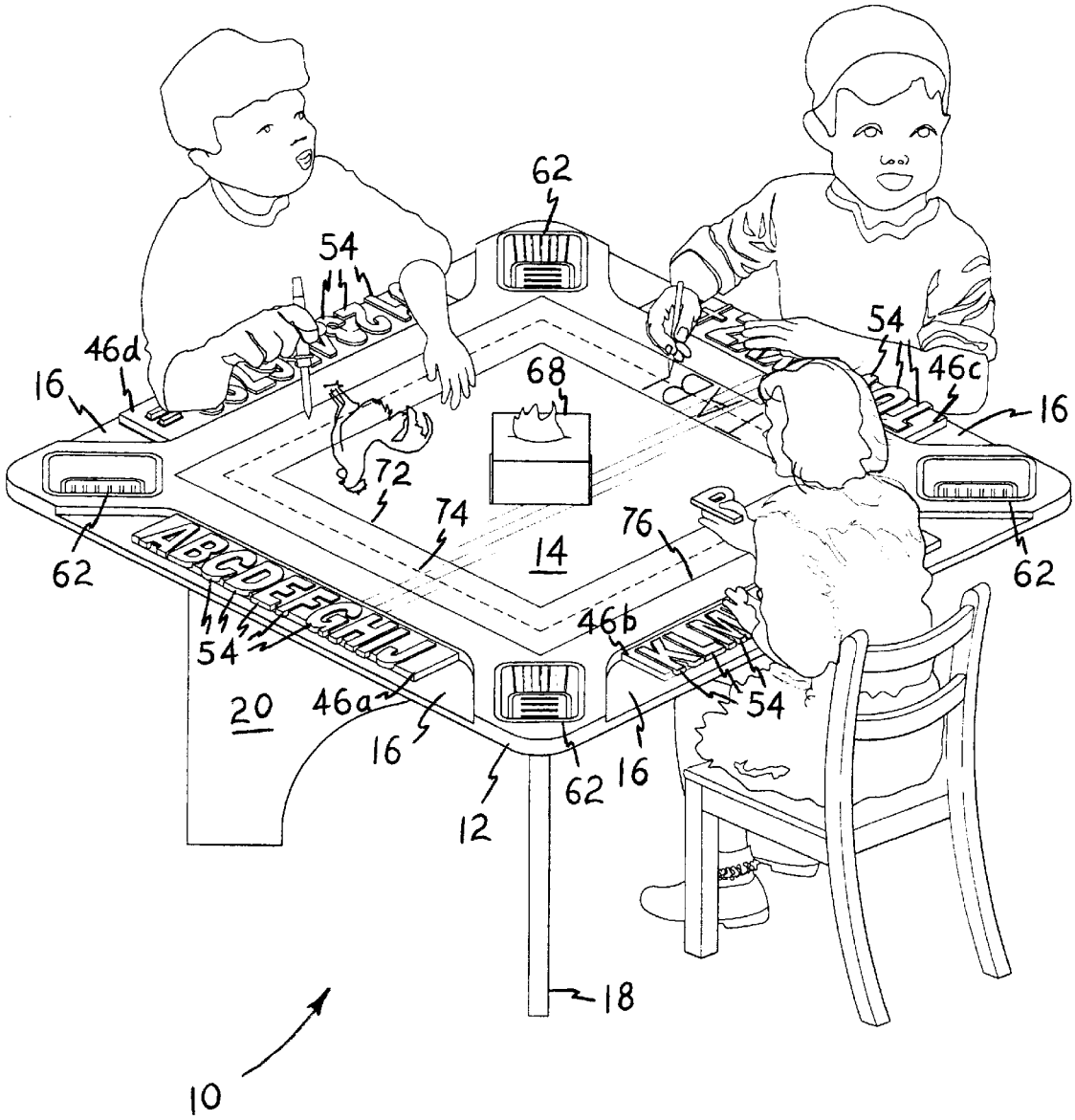
FIG. 1 is an environmental perspective view of the present children's activity table, illustrating various features and functions thereof.

The present invention comprises a children's activity table, designated by the reference numeral 10 in the drawings. The table 10 is configured for very young children down to toddler size, and provides them with an area which can be used for drawing, marking, and writing for those children capable of such. The table 10 also includes a series of removable panels with removably placeable alphanumeric characters thereon, providing further educational and entertainment value for children using the present table.

Figure 2:
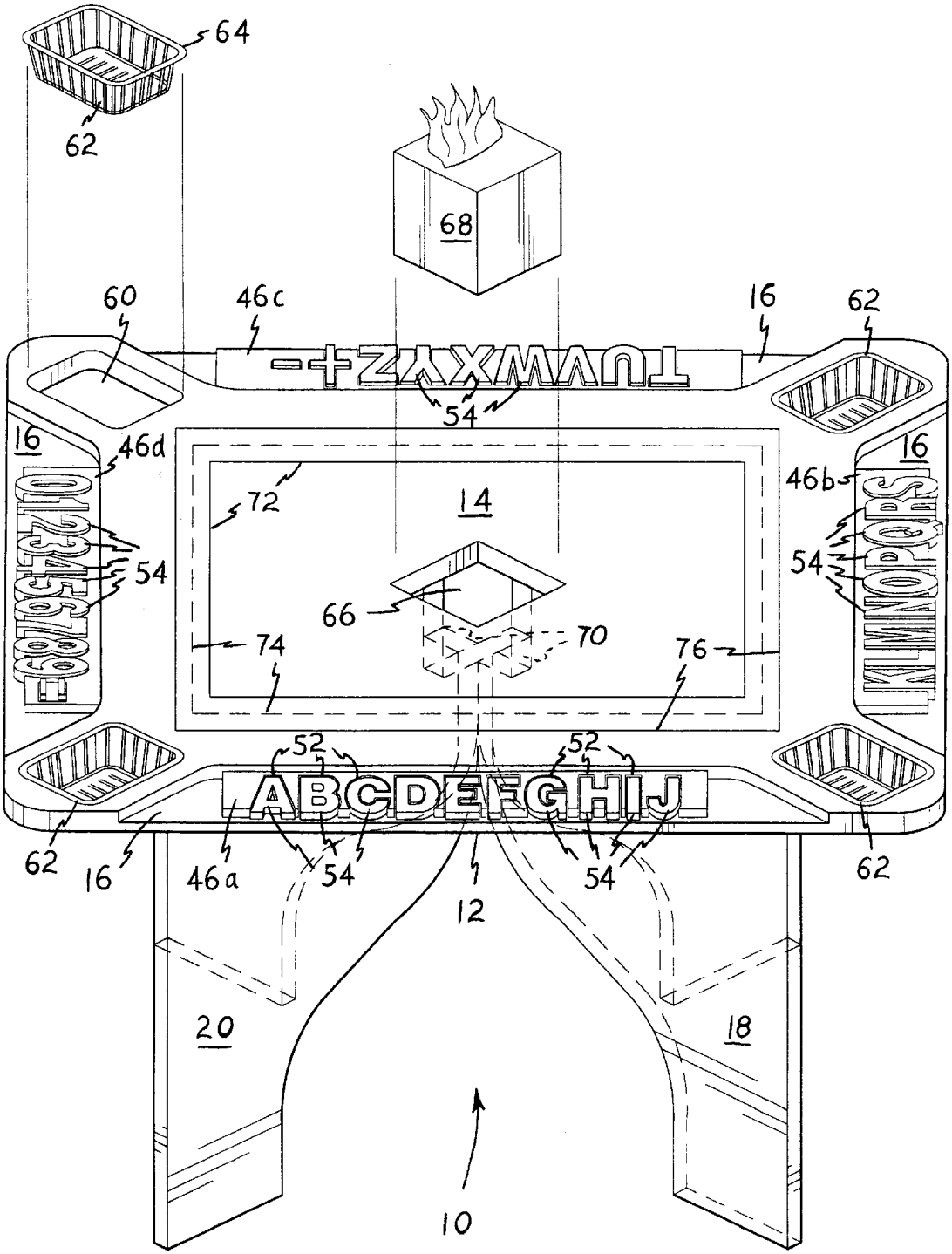
FIG. 2 is a detailed perspective view of the present table, showing the receptacle openings therein and removable placement of storage receptacles in the corresponding openings.

FIGS. 1 and 2 provide views of the overall table 10, and particularly its table top 12. The table top 12 is formed of a rigid, thin, flat material with a "whiteboard" upper surface 14, providing a dry erasable surface for using compatible markers thereon. The table top 12 is preferably generally square (with all corners being rounded for safety), with each of the four sides or edges having a slightly recessed periphery 16 for removable placement of alphanumeric characters or other articles thereon. This feature is shown in detail in FIGS. 2, 3, and 4, and discussed in detail further below. The table top 12 may be formed in any of a number of regular or irregular geometric shapes, as desired, and is not necessarily restricted to the square shape illustrated throughout the drawing Figures. For example, the table top may have a circular shape, if desired, or comprise some other regular polygonal shape (e. g., hexagon, etc.) to provide a different number of sides. However, the table top support means discussed below, lends itself well to a square table top 12.

Figure 5:
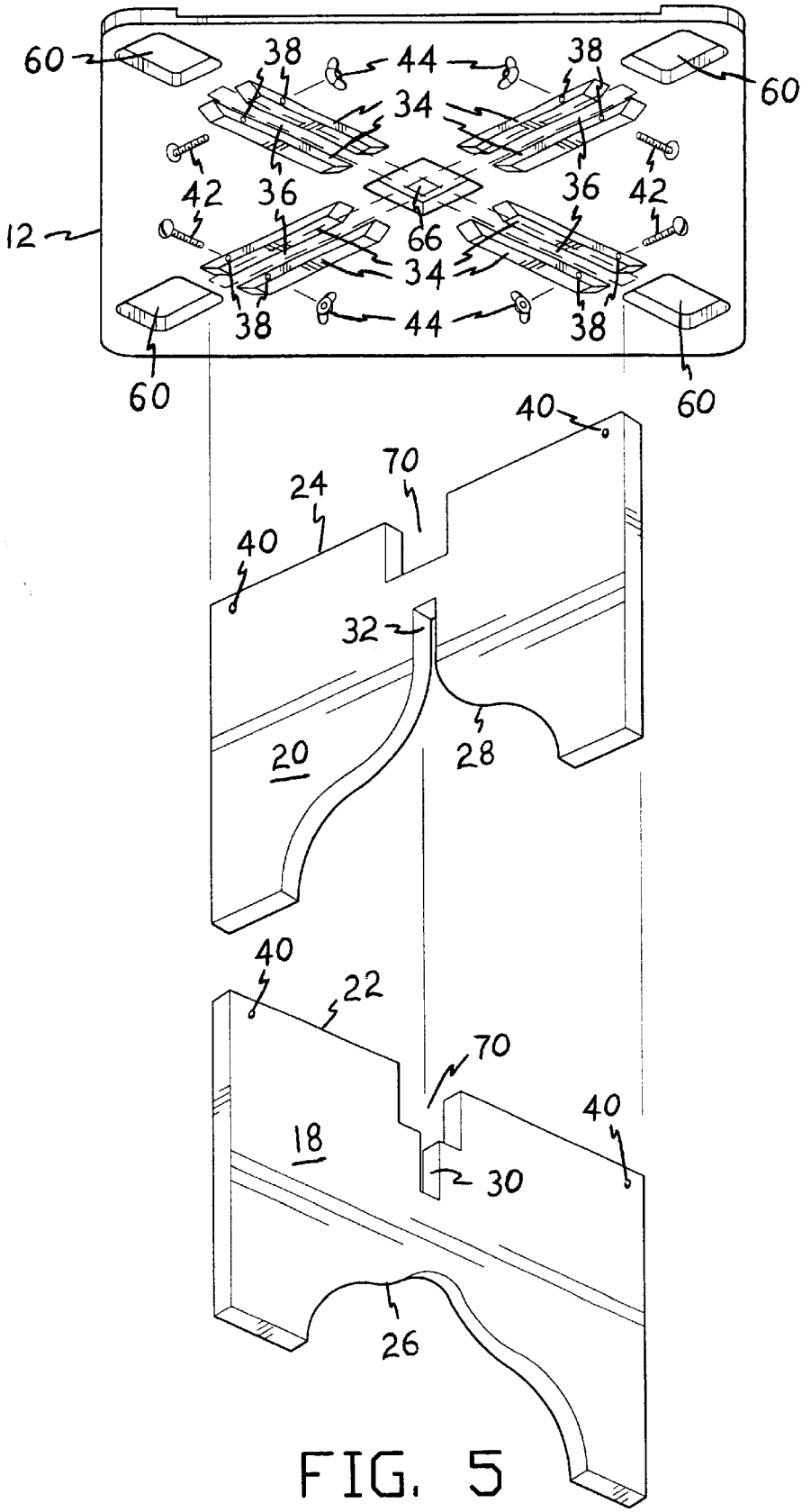
FIG. 5 is an exploded perspective view of the underside of the table top and cruciform support panels, showing their attachment means to one another.
Figure 6:
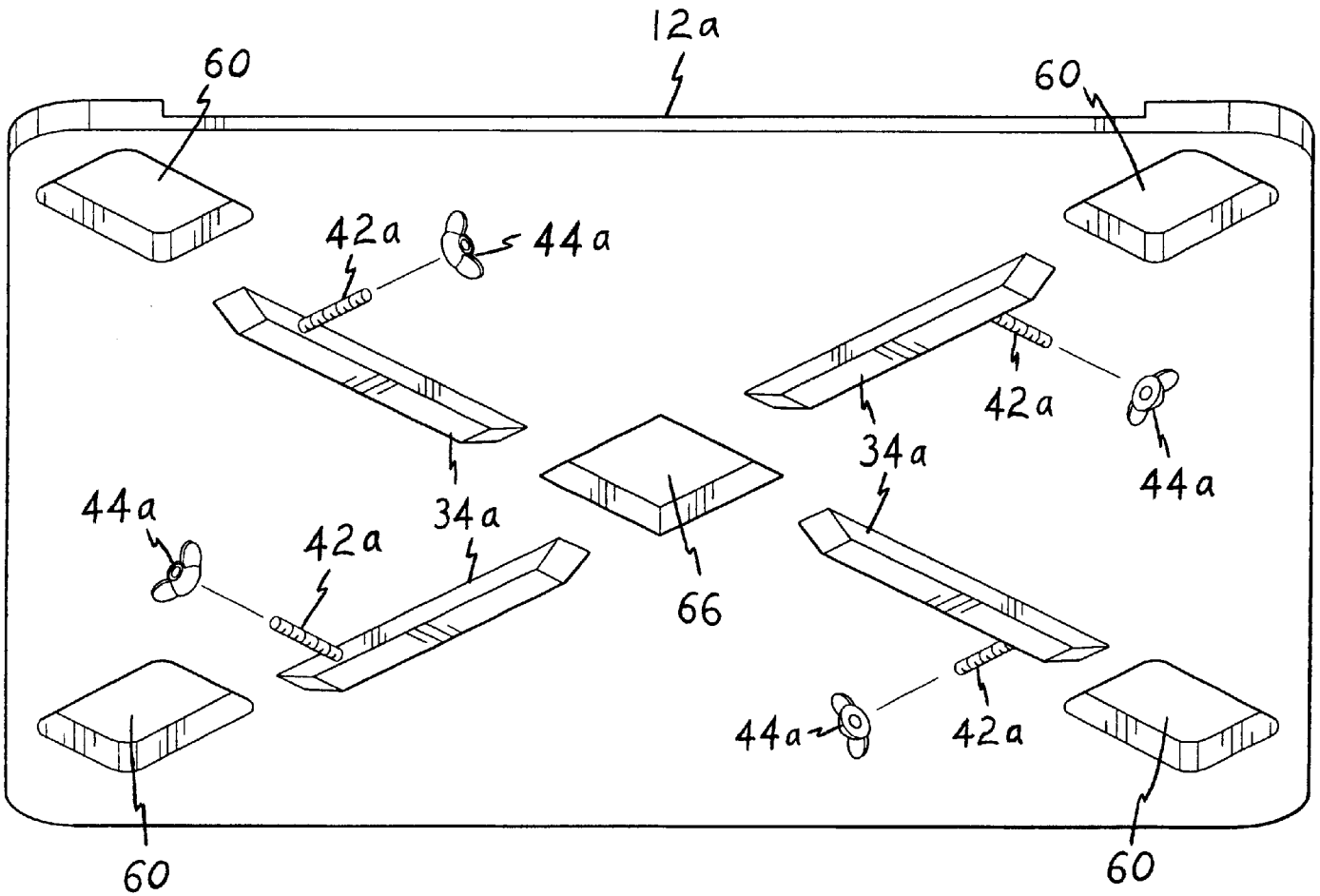
FIG. 6 is a detailed perspective view of an alternative embodiment of the underside of the table top, showing alternative means for attaching the support panels to the table top.

FIGS. 5 and 6 illustrate the assembly of the first and second table top support panels, respectively 18 and 20, and two different embodiments for removably but positively securing the two panels 18 and 20 to the underside of the table top 12. Each panel 18 and 20 is formed of a rigid, thin, flat sheet of material (e.g., wood, plastic, etc.), in generally the same manner as the table top 12. However, the panels 18 and 20 interlock together to form a cruciform configuration when assembled. Each table top support panel 18 and 20 has an upper edge, respectively 22 and 24, and an opposite lower edge, respectively 26 and 28. The first panel 18 has an assembly slot 30 formed in the upper edge 22 thereof (extending through a wider opening or cutout, explained further below), while the second panel 20 has a mating assembly slot 32 extending from its lower edge 28. These two complementary slots 30 and 32 mutually engage one another, as indicated in FIG. 5, to form the cruciform table top support assembly comprising panels 18 and 20, shown supporting the table top 12 in FIGS. 1 and 2.

FIGS. 5 and 6 also show two different means for positively but removably securing the table top support panel assembly 18, 20 to the underside of the table top 12. In FIG. 5, pairs of cleats 34 are secured beneath the table top 12, in a diagonal arrangement. That is, one pair of cleats 34 extends from the center of the table top 12, toward each of the four corners of the table top, comprising a total of eight cleats 34. Each pair includes a slot 36 therebetween, for capturing the corresponding upper edge 22 or 24 of the corresponding table top support panel 18 or 20.

Each cleat 34 has a lateral fastener passage 38 therethrough, with the upper edges 22, 24 of each table top support panel 18, 20 having corresponding fastener passages 40 formed therethrough. The two panels 18 and 20 are assembled together by means of their mating slots 30 and 32, and the table top 12 is placed atop the support panel assembly of panels 18 and 20, with the upper edges 22 and 24 of the two panels 18 and 20 engaging the corresponding channel or slot 36 between each pair of cleats or battens 34. A fastener pin 42 (e. g., bolt, etc.) is inserted through the aligned passages 38 and 40 of each pair of cleats 34 and its corresponding support panel upper edge 22 and 24, to secure the table top 12 to the support panel assembly 18, 20. A mating fastener 44 (e. g., wing nut, etc.) is then secured to the end of each of the fastener pins 42, to lock the assembly together. Disassembly is easily accomplished by reversing the above procedure, with the three panels 12, 18, and 20 lying flat to provide for compact storage and transport of the present children's activity table 10.

FIG. 6 illustrates an alternative embodiment of the arrangement illustrated in FIG. 5. In FIG. 6, a table top 12*a* is provided with only a single diagonally disposed cleat or batten 34*a* extending in each direction from the center of the table top 12*a*. These single cleats 34*a* are in the same location as one cleat 34 forming each of the pairs of cleats 34 in the arrangement of FIG. 5, i. e., slightly offset from the diagonal to allow the upper edges 22, 24 of the support panels 18, 20 to extend along the diagonal of the table top 12*a*.

Each single cleat 34*a* has a fastener pin 42*a* extending laterally therefrom, as shown in FIG. 6 of the drawings. These fastener pins 42*a* may be either permanently or removably secured through corresponding passages (not shown, but essentially the same as the passages 38 of the cleats 34 shown in FIG. 5). If the fastener pins 42*a* are permanently secured in their corresponding cleats 34*a*, the table top 12*a* is easily secured to the underlying support panel assembly 18, 20 by slightly misaligning the table top 12*a* atop the cruciform upper edges 22, 24 of the two support panels 18, 20, and rotating the table top 12 in the direction of the extended fastener pins 42*a*. This causes the pins 42*a* to pass through the corresponding holes 40 in the upper edges 22, 24 of the two table top support panels 18, 20, whereupon they may be secured in place by the mating fasteners 44*a*.

Figure 3:
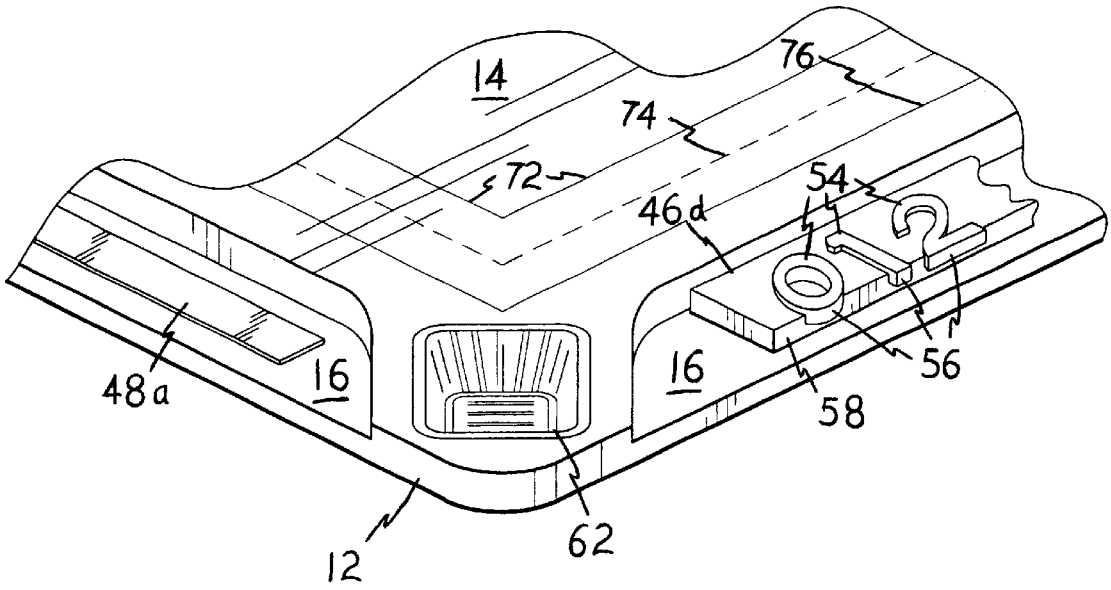
FIG. 3 is a broken away detailed perspective view of one corner of the table top of the present table, showing the protruding lower edges of a series of alphanumeric characters provided with the table, for ease of manipulation thereof.
Figure 4:
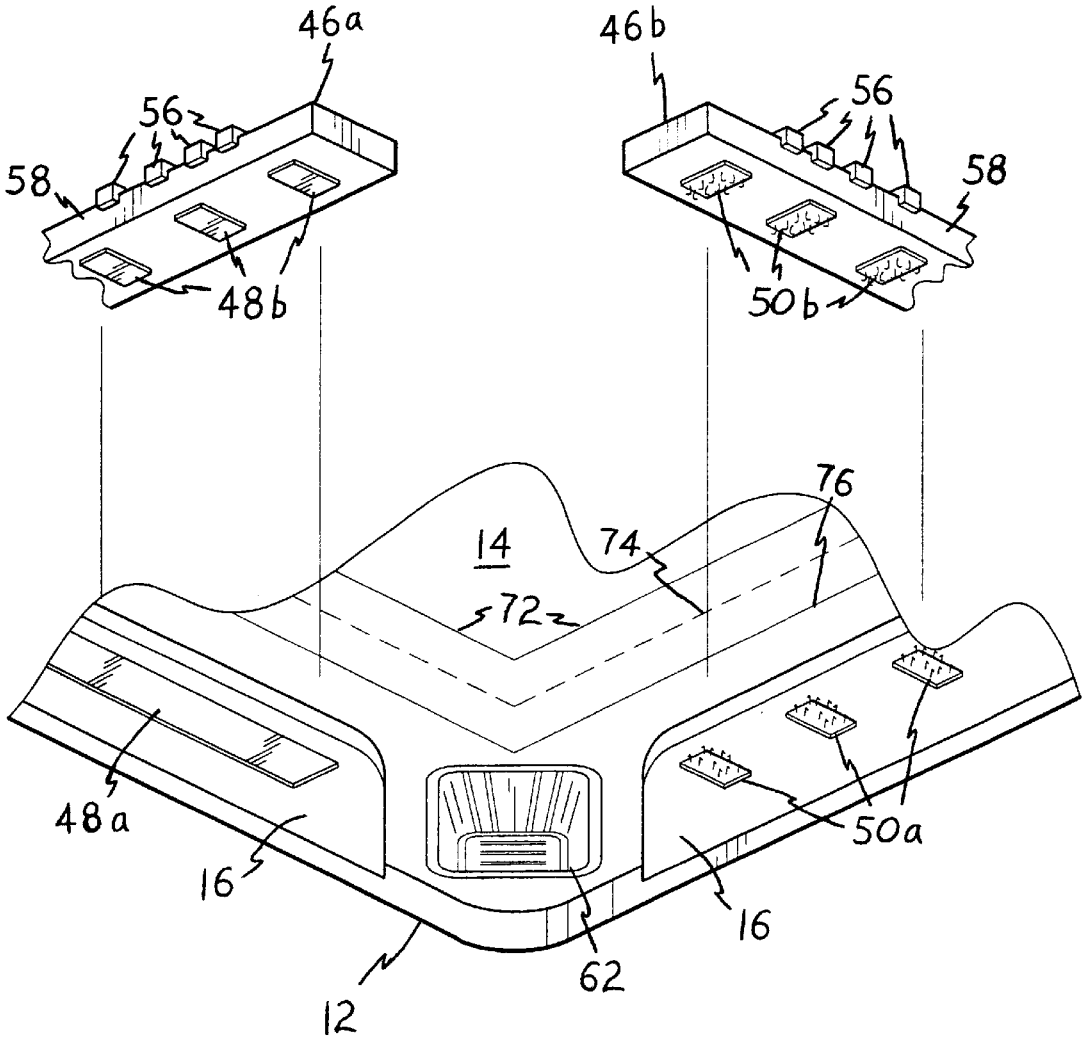
FIG. 4 is an exploded perspective view showing the means for removably attaching panels for holding the alphanumeric characters in place.

FIGS. 2 through 4 disclose further details of the table top 12 (or 12*a*), including the recessed periphery 16 and articles removably attachable thereto. A removably installable panel, respectively 46*a* through 46*d*, is provided for each peripheral recess 16, as shown in FIG. 4 of the drawings. These panels 46*a* through 46*d* may be secured to the respective underlying peripheral recess 16 by any practicable means desired, such as the magnetic panels 48*a*, 48*b* or the mating hook and loop fastener material 50*a*, 50*b* illustrated in FIG. 4, for respectively removably securing the two panels 46*a* and 46*b* to the table top 12.

Each of the removable panels 46*a* through 46*d* includes a series of recesses 52 formed therein, with each recess 52 configured specifically to closely fit a different alphanumeric character or arithmetical sign 54. The panels 46*a* through 46*d* may be formed to have a width slightly narrower than the height of the alphanumeric characters 54, if so desired, as shown particularly in FIGS. 3 and 4. In this manner, the lower portions 56 of the characters 54 will extend slightly beyond the lower edge 58 of the panels 46*a* through 46*d*. This facilitates gripping and manipulating the characters 54 for users of the present table 10, particularly for younger users who have not yet developed their coordination and motor skills fully. Alternatively, it will be seen that the panels 46*a* through 46*d* may be made slightly wider, and/or the characters 54 made slightly shorter, in order for each character 54 to fit completely within its corresponding recess, if so desired.

FIGS. 2, 5, and 6 show the container openings formed through the table top 12, for the removable insertion of various types of containers therein. The periphery of the table top 12 includes a series of container openings 60 therethrough, with these peripheral container openings or passages 60 preferably being positioned at the corners of the table top 12, between each of the peripheral recesses 16. These container openings 60 each provide for the removable insertion of a storage container 62 therein, for holding erasable markers, crayons, cleaning tissues or cloths, etc., as desired. The storage containers 62 are small open baskets with extended flanges 64, which fit over the edges of the openings 60.

The table top 12 (and 12*a*) further include an additional, centrally located opening 66 therein. This central opening 66 provides for the removable insertion and temporary securing of a tissue container 68 or the like therein, for providing cleaning tissues or cloths for erasing or wiping the erasable marking surface 14 of the table top 12 or 12*a*. The underlying support panels 18 and 20 each have a central open area 70 formed in the upper edges 22 and 24 thereof, to provide a relatively deep receptacle and support for the tissue container 68 or other article placed within the central opening 66 of the table top 12/12*a*.

In conclusion, the present children's activity table provides a most desirable means for small children and toddlers to entertain themselves in an educational manner. The present table is a significant improvement over conventional chalk boards and the like, with their conventional easels or vertical wall mounting. The present table allows small children to draw, write, manipulate various alphanumeric characters, play games, etc. on the surface thereof, which versatility cannot be met by a conventional chalk board or other devices known to the present inventor. The present table offers further versatility by means of upper case, lower case, and base guidelines, respectively 72 through 76, which may be permanently marked about the periphery of the table top 12 inboard of the peripheral recesses 16 and openings 60. Children may use the open area of the table top 12 as desired for drawing, etc., and/or may write, print, or trace the alphanumeric characters provided with the table, in the guidelines 72 through 76.

When storage of the present table is desired, disassembly is easily accomplished by unfastening the fasteners securing the underlying support panels from their mating cleats beneath the table top, lifting the second support panel from the first support panel, and placing the three panels (table top and two support panels) in a compact stack for storage or transportation. Assembly is easily accomplished by reversing the disassembly procedure. Accordingly, the present children's activity table will find wide use in day care centers, schools, homes, and any other locations where small children spend time playing and learning.

It is to be understood that the present invention is not limited to the embodiments described above, but encompasses any and all embodiments within the scope of the following claims.

I claim:

1. A children's activity table, comprising:

a table top having a dry erasable surface thereon;

said table top further having at least one peripheral area recessed below said dry erasable surface, for removable placement of articles thereon;

a first and a second table support panel, said table top being mounted on said first and said second table support panel;

each said panel comprising a single thin, flat, rigid sheet of material having an upper edge and a lower edge opposite said upper edge; and said first table support panel having an assembly slot formed in said upper edge thereof, and said second table support panel having an assembly slot formed in said lower edge thereof for assembling each said table support panel together in a cruciform configuration by mutually engaging each said assembly slot with one another.

2. The children's activity table according to claim 1 further including attachment means for positively securing said table top to each said support panel, the attachment means comprising:

a plurality of diagonally disposed cleats depending from beneath said table top;

each of said cleats having a fastener passage formed laterally therethrough;

said upper edge of each said support panel having at least one fastener passage formed therethrough;

each said fastener passage of said cleats aligning with a corresponding fastener passage of one said support panel, when each said support panel is assembled with one another to form a cruciform support panel assembly and said table top is placed atop said support panel assembly;

a plurality of fastener pins corresponding in number to each said fastener passage of said cleats, for removably installing through each said fastener passage of said cleats and each said fastener passage of each said support panel; and a plurality of mating fasteners corresponding in number to said plurality of fastener pins, for removably securing to said fastener pins for securing said upper edge of each said support panel to said table top.

3. The children's activity table according to claim 1, further including:

a removable panel installed in said at least one recessed peripheral area; and a plurality of removable alphanumeric characters disposed upon said removable panel.

4. The children's activity table according to claim 1, wherein said table top has at least one opening defined therein for removably placing a storage container therein.

5. The children's activity table according to claim 1, wherein:

said table top has a plurality of openings defined therein peripherally disposed about said table top and one central opening disposed through said table top; and said support panel assembly further includes a centrally disposed open area formed in said upper edge of each said support panel, for providing clearance and support for a storage container removably installed in said central opening of said table top.

6. The children's activity table according to claim 5, further including:

a plurality of open storage containers removably installed in said peripherally disposed openings of said table top, and;

a tissue container removably installed in said central opening of said table top.

7. A children's activity table, comprising:

a table top having a dry erasable surface thereon and having at least one opening defined therethrough for removable placement of a storage receptacle therein, and at least one recessed peripheral area formed in said table top; and a first and a second table support panel, said table top being mounted on said first and said second table support panel;

each said panel comprising a single thin, flat, rigid sheet of material having an upper edge and a lower edge opposite said upper edge;

said first table support panel having an assembly slot formed in said upper edge thereof, and said second table support panel having an assembly slot formed in said lower edge thereof for assembling each said table support panel together in a cruciform configuration by mutually engaging each said assembly slot with one another.

8. The children's activity table according to claim 7, further including attachment means for positively securing said table top to each said support panel, the attachment means comprising:

a plurality of diagonally disposed cleats depending from beneath said table top;

each of said cleats having a fastener passage formed laterally therethrough;

said upper edge of each said support panel having at least one fastener passage formed therethrough;

each said fastener passage of said cleats aligning with a corresponding fastener passage of one said support panel, when each said support panel is assembled with one another to form a cruciform support panel assembly and said table top is placed atop said support panel assembly;

a plurality of fastener pins corresponding in number to each said fastener passage of said cleats, for removably installing through each said fastener passage of said cleats and each said fastener passage of each said support panel; and a plurality of mating fasteners corresponding in number to said plurality of fastener pins, for removably securing to said fastener pins for securing said upper edge of each said support panel to said table top.

9. The children's activity table according to claim 7, further including:

a removable panel installed in said at least one recessed peripheral area; and a plurality of removable alphanumeric characters disposed upon said removable panel.

10. The children's activity table according to claim 7, wherein:

said at least one opening further comprises a plurality of openings peripherally disposed through said table top and a central opening disposed through said table top; and said support panel assembly further includes a centrally disposed open area formed in said upper edge of each said support panel, for providing clearance and support for a storage container removably installed in said central opening of said table top.

11. The children's activity table according to claim 10, further including:

a plurality of open storage containers for removably installing in said peripherally disposed openings of said table top, and;

a tissue container for removably installing in said central opening of said table top.

12. A children's activity table, comprising:

a rigid, thin, flat table top;

a first and a second table support panel;

each said panel comprising a single thin, flat, rigid sheet of material having an upper edge and a lower edge opposite said upper edge;

said first table support panel having an assembly slot formed in said upper edge thereof and said second table support panel having an assembly slot formed in said lower edge thereof, for assembling each said table support panel together in a cruciform configuration by mutually engaging each said assembly slot with one another;

a plurality of diagonally disposed cleats depending from beneath said table top;

each of said cleats having a fastener passage formed laterally therethrough;

said upper edge of each said support panel having at least one fastener passage formed therethrough;

each said fastener passage of said cleats aligning with a corresponding fastener passage of one said support panel, when each said support panel is assembled with one another to form a cruciform support panel assembly and said table top is placed atop said support panel assembly;

a plurality of fastener pins corresponding in number to each said fastener passage of said cleats, for removably installing through each said fastener passage of said cleats and each said fastener passage of each said support panel; and a plurality of mating fasteners corresponding in number to said plurality of fastener pins, for removably securing to said fastener pins for securing said upper edge of each said support panel to said table top by means of said cleats.

13. The children's activity table according to claim 12, further including a dry erasable surface disposed upon said table top.

14. The children's activity table according to claim 12, further including at least one recessed peripheral area formed in said table top.

15. The children's activity table according to claim 14, further including:

a removable panel disposed in said at least one recessed peripheral area; and a plurality of removable alphanumeric characters disposed upon said removable panel.

16. The children's activity table according to claim 12, wherein said table top has at least one opening defined therein for removable placement of a storage receptacle therein.

17. The children's activity table according to claim 12, wherein:

said table top has a plurality of openings defined therethrough peripherally disposed about said table top and a central opening disposed through said table top; and said support panel assembly further includes a centrally disposed open area formed in said upper edge of each said support panel, for providing clearance and support for a storage container removably installed in said central opening of said table top.

18. The children's activity table according to claim 17, further including:

a plurality of open storage containers removably disposed in said peripherally disposed openings of said table top, and;

a tissue container for removably installing in said central opening of said table top.

* * * * *